US008333679B2

(12) United States Patent
Richter et al.

(10) Patent No.: US 8,333,679 B2
(45) Date of Patent: Dec. 18, 2012

(54) ARRANGEMENT FOR MOUNTING AND ATTACHING A PLANETARY GEAR TO A CAMSHAFT AND METHOD FOR MOUNTING THE PLANETARY GEAR

(75) Inventors: Frank Richter, Oberteuringen (DE); Ewald Schmitz, Daisendorf (DE); Jochen Walliser, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 13/063,775

(22) PCT Filed: Sep. 30, 2009

(86) PCT No.: PCT/EP2009/062668

§ 371 (c)(1),
(2), (4) Date: Mar. 14, 2011

(87) PCT Pub. No.: WO2010/049232

PCT Pub. Date: May 6, 2010

(65) Prior Publication Data

US 2011/0201474 A1 Aug. 18, 2011

(30) Foreign Application Priority Data

Oct. 30, 2008 (DE) ..... 10 2008 043 337

(51) Int. Cl.
*F16H 57/08* (2006.01)

(52) U.S. Cl. ..... 475/331

(58) Field of Classification Search ..... 475/331
See application file for complete search history.

(56) References Cited

U.S. PATENT DOCUMENTS

| | | | | |
|---|---|---|---|---|
| 3,734,073 | A | 5/1973 | Walter et al. | |
| 4,305,352 | A * | 12/1981 | Oshima et al. | 123/90.15 |
| 5,174,253 | A * | 12/1992 | Yamazaki et al. | 123/90.17 |
| 5,327,859 | A | 7/1994 | Pierik et al. | |
| 7,182,709 | B2 * | 2/2007 | Christ et al. | 475/348 |
| 7,624,710 | B2 | 12/2009 | Uehama et al. | |
| 2010/0064998 | A1 | 3/2010 | Hale et al. | |

FOREIGN PATENT DOCUMENTS

| | | | |
|---|---|---|---|
| DE | 692 17 181 | T2 | 8/1997 |
| DE | 100 54 796 | A1 | 6/2002 |
| DE | 10 2007 000 809 | A1 | 4/2008 |
| DE | 10 2007 017 897 | A1 | 10/2008 |
| WO | 2006/018254 | A1 | 2/2006 |

* cited by examiner

*Primary Examiner* — Justin Holmes
*Assistant Examiner* — David J Hlavka
(74) *Attorney, Agent, or Firm* — David & Bujold, PLLC

(57) ABSTRACT

An arrangement for mounting and fixing a planetary gear system (3) onto a camshaft (2). The planetary gear system comprises a planetary carrier (5) that forms the drive input of the camshaft (2), with planetary gears (7) mounted on planetary bolts (6). A ring gear (10) is rotationally fixedly connected to the camshaft (2), and a sun gear (8) is connected with a sun shaft (9). The ring gear (10) is arranged at the end of and coaxially with the camshaft (2) and is rotationally fixedly connected to the camshaft (2) by eccentrically arranged fixing elements (4).

15 Claims, 1 Drawing Sheet

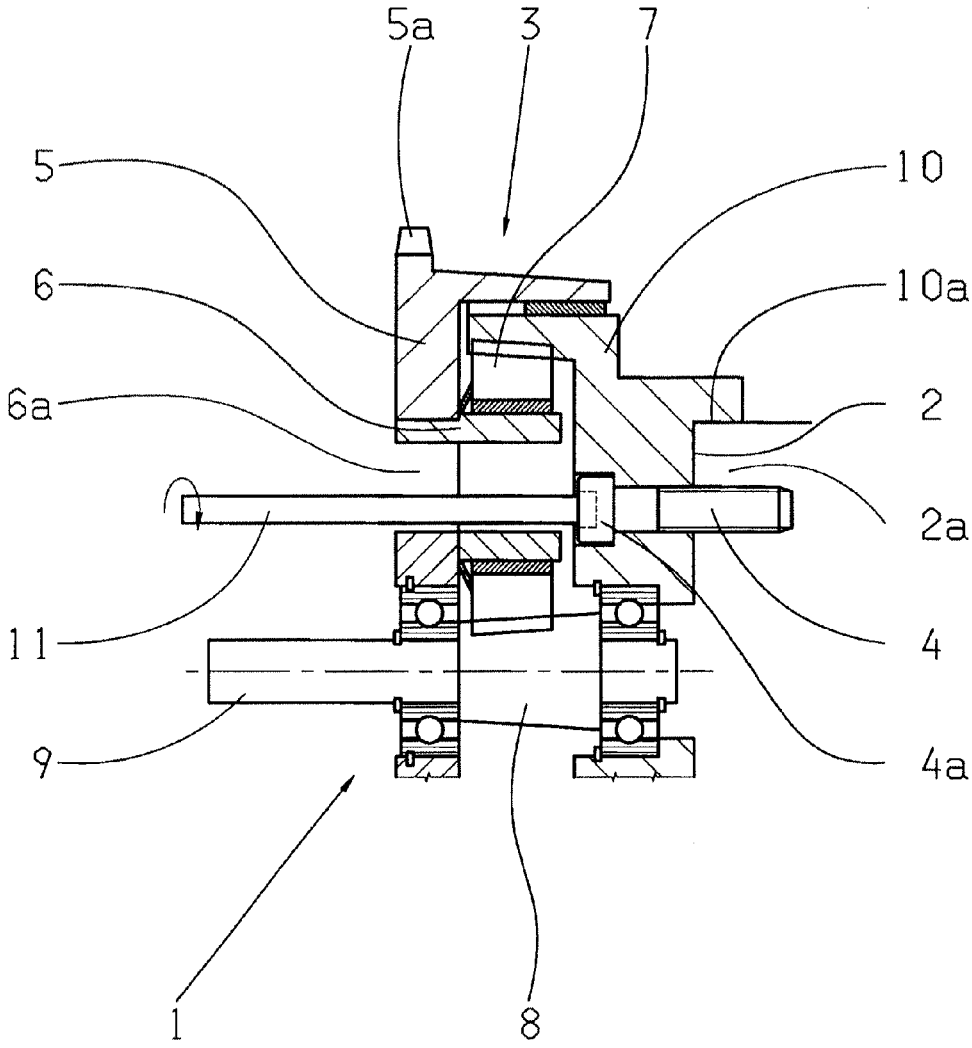
5a
3
7
5
10
6
10a
6a
2
2a
11
4
9
4a
1
8

ARRANGEMENT FOR MOUNTING AND ATTACHING A PLANETARY GEAR TO A CAMSHAFT AND METHOD FOR MOUNTING THE PLANETARY GEAR

This application is a National Stage completion of PCT/EP2009/062668 filed Sep. 30, 2009, which claims priority from German patent application serial no. 10 2008 043 337.3 filed Oct. 30, 2008.

FIELD OF THE INVENTION

The invention concerns an arrangement for mounting a planetary gear system, and a method for fitting a planetary gear.

BACKGROUND OF THE INVENTION

Planetary gear systems are used for the driving and adjustment of camshafts and, for that purpose, are fixed onto the front of the camshaft of an internal combustion engine.

A camshaft adjustment device is known, from WO 2006/018254 A1, which comprises a planetary gear system by means of which a camshaft can be driven and its rotation angle can be adjusted. The planetary gear system comprises a planetary carrier with planetary gears which mesh with a sun and a ring gear. The planetary gear system is driven via its planetary carrier and drives the ring gear, which is connected rotationally fixed to the camshaft. The camshaft is adjusted by means of the sun gear.

It is known to connect planetary gear systems to the camshaft by means of a central bolt. This has the disadvantage that the center of the planetary gear system, especially with gear ratios i>7, is covered by the sun gear geometry, i.e., it is not accessible. If the sun gear or the sun shaft were to be made hollow, then although this would allow accessibility to the central bolt for fitting purposes, such a solution would always entail a loss of power density and would require more structural fitting space.

SUMMARY OF THE INVENTION

The purpose of the present invention is to provide an arrangement for mounting and fixing, as mentioned at the start, which enables high power density and requires little fitting space for the planetary gear system and the camshaft adjustment device. A further purpose of the invention is to propose a simple method for fitting the planetary gear system.

Thanks to the eccentrically arranged fixing elements, in particular cylindrical bolts, the sun gear and the sun gear shaft can be designed and configured so as to optimize the fitting space required. Since there is no central fixing—as in the prior art—there is no need for a hollow sun shaft. By means of the axis-parallel extending fixing bolts, the ring gear and thus the entire planetary gear system are fixed at the front of the camshaft.

In an advantageous design, the ring gear is centered relative to the camshaft by a centering seating. This gives a coaxial arrangement of the planetary gear system and the camshaft. Advantageously, the said centering seating on the ring gear can be in the form of a centering bore, which holds the front end of the camshaft.

In a particularly preferred embodiment, the planetary bolts are hollow and the fixing elements are aligned with the planetary bolts. This gives the advantage that the fixing elements are accessible for assembly and fixing through the hollow spaces in the planetary bolts, preferably by means of a socket spanner for fixing the cylindrical bolts.

The planetary gear system is first ready assembled and set as a structural unit, onto the end of the camshaft, so that centering occurs at the same time. During or after this the fixing elements, in particular cylindrical bolts, are orientated in the circumferential direction aligned with the hollow planetary bolts. By means of a suitable fitting tool introduced from outside through the planetary bolts, the fixing elements can be fitted so that the ring gear, and thus the entire planetary gear system, are firmly connected to the camshaft. It is advantageous in the method, according to the invention, that the planetary gear system can be pre-assembled as a structural unit since this saves assembly time. A further advantage is that no sensitive gearteeth can be damaged by the fitting tool.

BRIEF DESCRIPTION OF THE DRAWINGS

An example embodiment of the invention is illustrated in the drawing and will be described below, in more detail, whereby further features and/or advantages can be seen from the description and/or the drawing.

DETAILED DESCRIPTION OF THE PREFERRED EMBODIMENTS

The single figure shows a view of a camshaft adjustment device 1. Of the camshaft 2 itself, only the front end 2*a* of the shaft is shown, on which a planetary gear system 3 is fixed by means of fixing elements in the form of cylindrical bolts 4. The planetary gear system 3 comprises a planetary carrier 5 with planetary bolts 6 on which planetary gears 7 (preferably three distributed around the circumference) are mounted. The planetary gears 7 mesh with a sun gear 8 made integrally with a sun shaft 9, and with a ring gear 10. The latter has a centering piece with a centering bore 10*a* in which the shaft end 2*a* of the camshaft 2 is held and centered. The ring gear 10 is held tight on the front shaft end 2*a* by the cylindrical bolts 4 and is, therefore, rotationally fixed to it. The planetary bolt 6 shown—like the other planetary bolts (not shown) arranged around the circumference—is made hollow, i.e., it has an axially through-going cylindrical hollow space 6*a*. The cylindrical bolt 4 shown—like the other cylindrical bolts (not shown)—is arranged approximately in line with the hollow space 6*a* so that the bolt head 4*a*, of the cylindrical bolt 4, is accessible by a fitting tool 11 inserted through the hollow space 6*a*. Thus, the number and arrangement of cylindrical bolts corresponds to the number and position of the hollow planetary bolts 6*a* so that they are accessible by the fitting tool 11.

The function of the camshaft adjustment device 1 is known, inter alia, from the prior art mentioned earlier. In relation to the example embodiment shown in the drawing, let it only be said that the drive input occurs via the planetary carrier 5 which, for that purpose, is in the form of a chain wheel with the corresponding teeth 5*a*. The drive output of the planetary gear system 3 occurs via the ring gear 10 to the camshaft 2. The camshaft 2 is adjusted by means of a positioning element (not shown) via the sun shaft 9 and the sun gear 8.

In a first step of the method, the planetary gear system 3 is fitted onto the camshaft 2 by first assembling the planetary gear system 3 as a structural unit. In the next step, the ready-assembled planetary gear system 3 is fitted onto the shaft end 2*a* of the camshaft 2, so that it is centered relative to the camshaft 2 by the centering bore 10*a*. Then, the planetary bolts 6 are orientated, in the circumferential direction, so that they are aligned with the cylindrical bolts 4 and the fitting tool 11 can then be introduced, from outside through the hollow space 6*a* of the planetary bolts 6, and fitted onto the bolt heads 4*a*. Depending on the cylindrical bolt 4, the fitting tool 11 is in the form of a socket spanner or an Allen key. Once the bolts 4 have been tightened, the planetary gear system 3 is connected firmly to the camshaft 2.

INDEXES

1 Camshaft adjustment device
2 Camshaft
2*a* Front end of the shaft
3 Planetary gear system
4 Cylindrical bolt
4*a* Bolt head
5 Planetary carrier
5*a* Teeth
6 Planetary bolts
6*a* Hollow space
7 Planetary gear
8 Sun gear
9 Sun shaft
10 Ring gear
10*a* Centering bore
11 Fitting tool

The invention claimed is:

1. An arrangement for mounting and fixing a planetary gear system (3) onto a camshaft (2), the planetary gear system comprising:

a planetary carrier (5) being designed as the drive input of the camshaft (2) with planetary gears (7) mounted on planetary bolts (6), a ring gear (10) being rotationally fixedly connected to the camshaft (2), and a sun gear (8) being supported by a sun shaft (9), wherein the ring gear (10) is arranged at the front of and coaxially with the camshaft (2) and is fixedly and directly non-rotatably connected to the camshaft (2) by a plurality of fixing elements (4), and each of the plurality of fixing elements (4) being radially spaced from a rotational axis of the sun shaft (9).

2. The arrangement according to claim 1, wherein the ring gear (10) is centered relative to the camshaft (2, 2*a*) by a centering seating (10*a*), 3. The arrangement according to claim 1, wherein at least one of the planetary bolts (6) is hollow.

4. An arrangement for mounting and fixing a planetary gear system (3) onto a camshaft (2), the planetary gear system comprising:

a planetary carrier (5) being designed as the drive input of the camshaft (2) with planetary gears (7) mounted on planetary bolts (6), a ring gear (10) being rotationally fixedly connected to the camshaft (2), and a sun gear (8) being supported by a sun shaft (9), wherein the ring gear (10) is arranged at the front of and coaxially with the camshaft (2)and is fixedly and non rotatably connected to the camshaft(2) by a plurality of rotatable fixing elements (4), and the fixing elements are in the form of cylindrical bolts (4) which are accessible through a hollow space (6*a*) of at least one of the planetary bolts (6).

5. The arrangement according to claim 1, wherein the sun gear (8) and the sun shaft (9) are integral with one another as a solid component having a non-hollow center.

6. The arrangement according to claim 2, wherein the centering seating is in the form of a centering bore (10*a*) in the ring gear (10) which retains the shaft end (2*a*) of the camshaft (2).

7. A method of fitting a planetary gear system onto a camshaft (2) in which the planetary gear system comprises a planetary carrier (5) designed as the drive input of the camshaft (2) with planetary gears (7) mounted on planetary bolts (6), a ring gear (10) fixedly and non-rotatably connected to the camshaft (2), and a sun gear (8) with a sun shaft (9), the ring gear (10) is arranged at the front of and coaxially with the camshaft (2) and is fixedly and directly non-rotatably connected to the camshaft (2) by a plurality of fixing elements (4), and each of the plurality of fixing elements (4) being radially spaced from a rotational axis of the sun shaft (9), the method comprising the steps of:

first assembling the planetary gear system (3) as an assembly, and then fitting and centering the assembly at the front end of the camshaft (2, 2*a*) and securing the ring gear (10) to the camshaft (2) via the plurality of fixing elements (4).

8. The method according to claim 7, further comprising the step of orientating the fixing elements in line with at least one hollow planetary bolt (6), and then introducing a fitting tool (11) through a hollow space of the at least one planetary bolt (6) for securing the fixing elements.

9. The method according to claim 8, further comprising the step of using as cylindrical bolts (4) as the fixing elements.

10. The arrangement according to claim 3, wherein the planetary bolts (6) are hollow with a cylindrical hollow space (6*a*), and the fixing elements (4) are arranged in an area of an axial extension of the hollow space (6*a*) in the ring gear (10).

11. The arrangement according to claim 1, wherein the ring gear (10) is located directly adjacent to and concentric with the camshaft (2).

12. The arrangement according to claim 1, wherein gear teeth (5*a*)are arranged on a radially exterior surface of the carrier (5).

13. The arrangement according to claim 1, wherein the camshaft (2) is coaxially and axially aligned with the sun gear (8).

14. The arrangement according to claim 1, wherein the ring gear (10) surrounds a portion of the sun shaft (9) and is rotatable relative thereto by a bearing.

15. The arrangement according to claim 1, wherein the plurality of fixing elements are cylindrical bolts (4) with heads, and the heads of the plurality of fixing elements are located axially between the planetary gears (7) and the camshaft (2).

* * * * *